US012337435B2

(12) United States Patent
Thompson

(10) Patent No.: US 12,337,435 B2
(45) Date of Patent: Jun. 24, 2025

(54) BUFFER AND SELF-FEEDING COMPOUND APPARATUS

(71) Applicant: Timothy Edward Thompson, Burlington, WA (US)

(72) Inventor: Timothy Edward Thompson, Burlington, WA (US)

( * ) Notice: Subject to any disclaimer, the term of this patent is extended or adjusted under 35 U.S.C. 154(b) by 0 days.

(21) Appl. No.: 18/729,846

(22) PCT Filed: Jan. 17, 2023

(86) PCT No.: PCT/US2023/010953
§ 371 (c)(1),
(2) Date: Jul. 17, 2024

(87) PCT Pub. No.: WO2023/137228
PCT Pub. Date: Jul. 20, 2023

(65) Prior Publication Data

US 2025/0108472 A1 Apr. 3, 2025

Related U.S. Application Data

(60) Provisional application No. 63/300,217, filed on Jan. 17, 2022.

(51) Int. Cl.
*B24B 23/02* (2006.01)
*B24B 23/00* (2006.01)
*B24B 57/02* (2006.01)

(52) U.S. Cl.
CPC ..... *B24B 23/02* (2013.01); *B24B 23/005* (2013.01); *B24B 57/02* (2013.01)

(58) Field of Classification Search
CPC ..... B24B 23/00; B24B 23/005; B24B 23/02; B24B 23/026; B24B 23/03; B24B 29/00;
(Continued)

(56) References Cited

U.S. PATENT DOCUMENTS 1,952,910 A 3/1934 Decker
5,309,594 A 5/1994 Thompson
(Continued)

FOREIGN PATENT DOCUMENTS

CN 207506548 U 6/2018
DE 202013101471 U1 4/2013
(Continued)

OTHER PUBLICATIONS

Bosch, Bosch GPO 950 Heavy Duty Electric Polisher, 950 W, M14, 2,100 rpm, 180 mm Dia., Variable Speed, Constant Speed, Soft Start, 2.3 kg + 4 Bosch Accessories, 1 Year Warranty, Retrieved From Internet, Retrieved On May 1, 2025, <URL: https://tinyurl.com/4u8jrvuk>.

(Continued)

*Primary Examiner* — C. A. Rivera

(57) ABSTRACT

A buffer and self-feeding apparatus includes a polishing device, a pump assembly, a pressurized reservoir, a collapsible cartridge, and a backing plate. The polishing device provides rotational energy to the backing plate as the backing plate is rotatably mounted to a spindle shaft of the polishing device. The backing plate functions as a rotational base to receive a polishing pad. The pressurized reservoir is mounted onto the casing and compressionally holds the collapsible reservoir that is filled with a quantity of polishing compound. The pump assembly is mounted onto the polishing device and is in fluid communication with the collapsible reservoir so that the user can selectively operate the pump assembly to dispense polishing compound onto the polishing pad without having to shut-off the polishing device.

9 Claims, 12 Drawing Sheets

(58) Field of Classification Search
CPC ..... B24B 57/00; B24B 57/02; B24B 57/04; A47L 11/03; A47L 11/08; A47L 11/085; A47L 11/40; A47L 11/408; A47L 11/4083
See application file for complete search history.

(56) References Cited

U.S. PATENT DOCUMENTS

| | | | | |
|---|---|---|---|---|
| 5,649,508 | A | 7/1997 | Rost et al. | |
| 6,132,301 | A * | 10/2000 | Kaiser | B24B 57/02 451/344 |
| 2004/0255410 | A1 | 12/2004 | Schonewille et al. | |
| 2005/0170758 | A1 | 8/2005 | Boyle | |
| 2009/0124184 | A1 | 5/2009 | Greer | |
| 2012/0034854 | A1 | 2/2012 | Greer | |
| 2012/0138162 | A1 * | 6/2012 | Beaulieu | B05B 12/1409 137/87.03 |
| 2015/0151401 | A1 * | 6/2015 | Shinozaki | B24B 37/005 451/5 |
| 2016/0263601 | A1 | 9/2016 | Micnerski | |
| 2019/0070705 | A1 | 3/2019 | Ishikawa | |

FOREIGN PATENT DOCUMENTS

| | | | |
|---|---|---|---|
| JP | 3131682 | B2 | 2/2001 |
| JP | 2021037472 | A | 3/2021 |
| WO | 2017056636 | A1 | 4/2017 |

OTHER PUBLICATIONS

Surie Polex, Concrete Buffing Machine, Retrieved From Internet, Retrieved On May 1, 2025, <URL: https://www.indiamart.com/proddetail/concrete-buffing-machine-6648079173.html>.

Brushmac India, Floor Buffing Machine, 17 inch, 1800 Watt, Retrieved From Internet, Retrieved On May 1, 2025, <URL: https://www.indiamart.com/proddetail/floor-buffing-machine-20464273912.html>.

Coido, Coido 6003 car polisher shining machine, Retrieved From Internet, Retrieved On May 1, 2025, <URL: https://tinyurl.com/yrajryzv>.

* cited by examiner

BUFFER AND SELF-FEEDING COMPOUND APPARATUS

The current application claims a priority to the U.S. provisional patent application Ser. No. 63/300,217 filed on Jan. 17, 2022.

FIELD OF THE INVENTION

The present invention relates generally to an apparatus for a buffing appliance. More specifically, the present invention is a buffing appliance with a rotating buffing wheel and reservoir to hold and discharge polishing compounds.

BACKGROUND OF THE INVENTION

Polishing is the process of creating a smooth and shiny surface by rubbing it or by applying a chemical treatment, leaving a clean surface with a significant specular reflection. In some materials (such as metals, glasses, black or transparent stones), polishing is also able to reduce diffuse reflection to minimal values. Polishing is generally implemented as a final step of a product and utilized within many different industries such as metal fabrication, carpentry, construction, and automotive detailing field. In reference to automotive detailing field, a buffer or polisher is utilized to streamline the polishing process. A buffer or polisher is a device used to work polish or wax into your vehicle and provide a shine that would be extremely hard to get manually with just a tub of wax and a cloth. The main drawback of the existing buffer or polisher is that it has to be stopped or removed from the polishing surface in order to apply the polishing compound to the buffing pad or the surface that requires polishing. Due to the continuous stopping of the buffer or polisher, detailers generally waste time and money every time a detail job is completed.

It is therefore an objective of the present invention to provide an apparatus that can dispense polishing compound while the buffer or polisher is operational. In other words, the present invention allows users to continuously use the buffer or polisher on a polishing surface without having to stop and restart. The user can selectively discharge the polishing compound upon user's preference through a pump system of the present invention. As a result, the present invention is able to save time and money during a detail job.

DETAIL DESCRIPTIONS OF THE INVENTION

Figure 1:
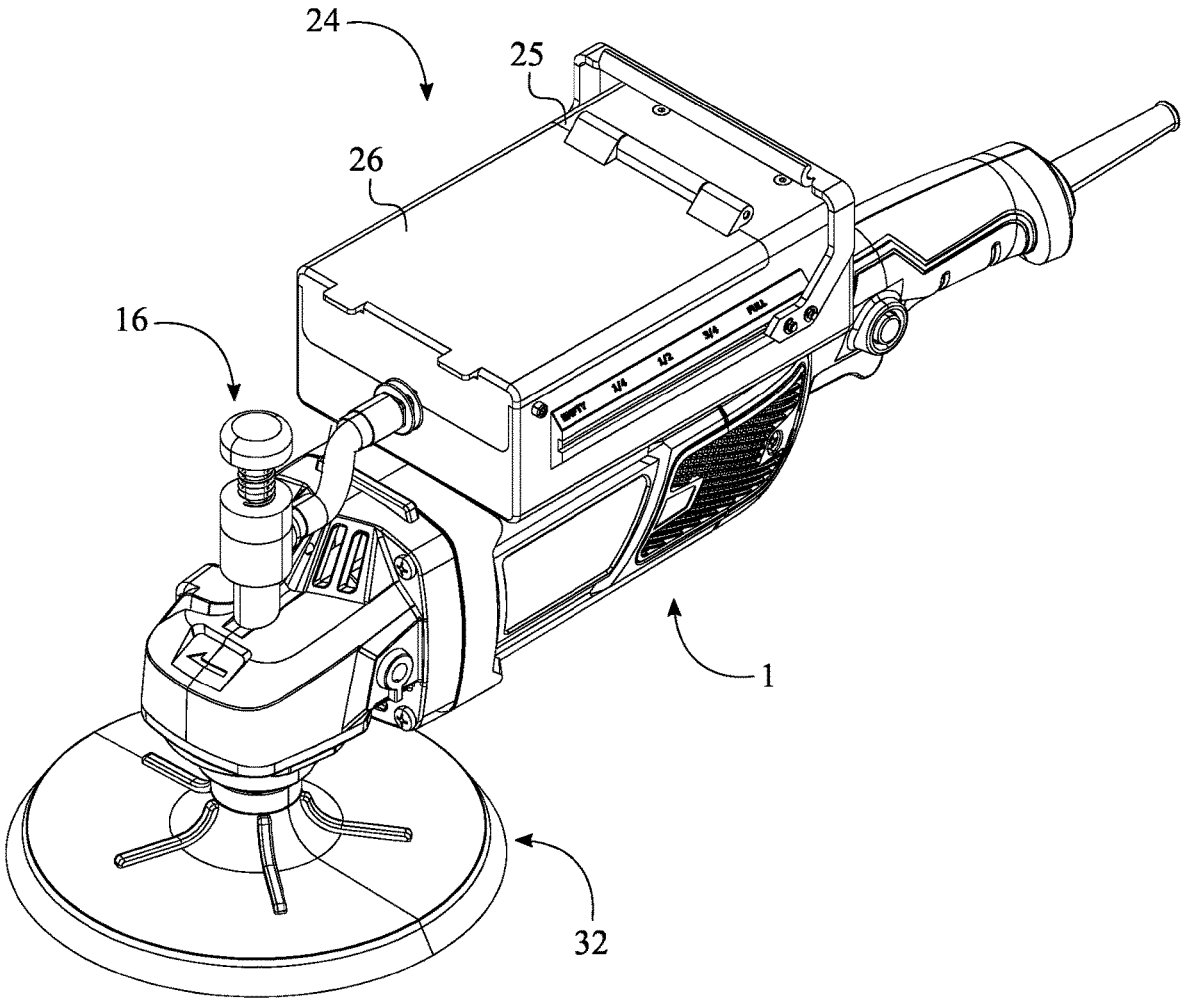
FIG. 1 is a perspective view of the present invention.

All illustrations of the drawings are for the purpose of describing selected versions of the present invention and are not intended to limit the scope of the present invention.

The present invention is a buffer and self-feeding apparatus that can discharge polishing compound onto a buffing surface without having to remove or shut-down the power tool. The configuration of the present invention also reduces compound overspray and maintain a clean work surface. The present invention comprises a polishing device 1, a pump assembly 16, a pressurized reservoir 24, a collapsible cartridge 29, and a backing plate 32 as shown in FIG. 1 and FIG. 2.

Figure 2:
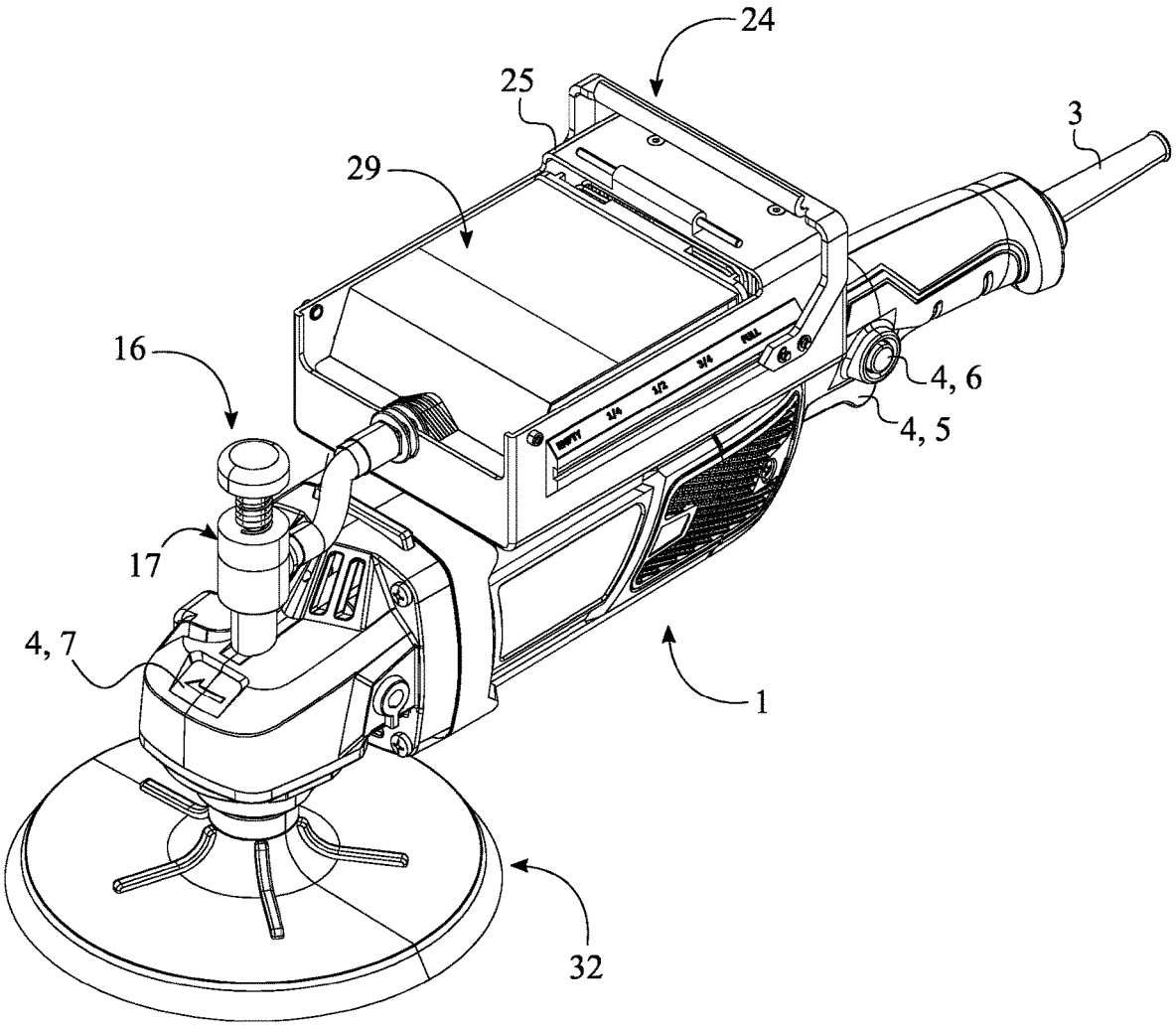
FIG. 2 is a perspective view of the present invention, showing the collapsible cartridge within the pressurized reservoir.
Figure 3:
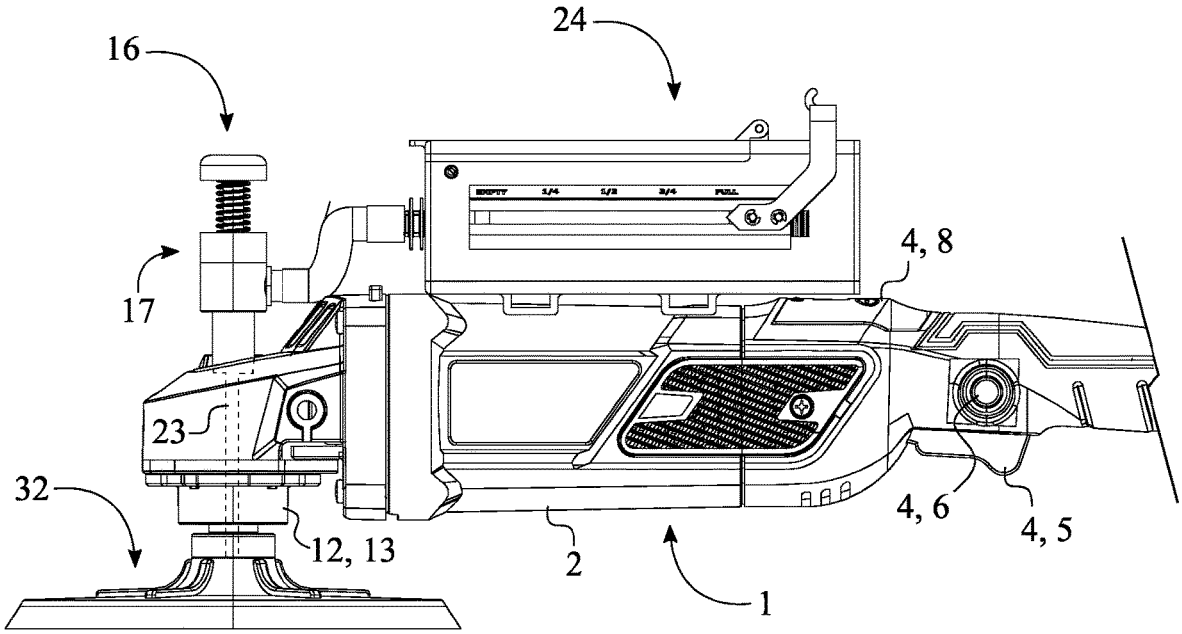
FIG. 3 is a side view of the present invention, wherein the dash line illustrate the internally positioned dispensing tube.

In reference to the general configuration, as shown in FIGS. 1-3, the polishing device 1 is a buffing/polishing tool to apply rotation motion onto the buffing surface. The polishing device 1 comprises a casing 2, a power source 3, a plurality of control features 4, a motor 9, and a spindle shaft 12. More specifically, the power source 3 and the plurality of control features 4 are externally integrated onto the casing 2. The motor 9 is internally mounted to the casing 2 to provide the rotational energy within the casing 2. The spindle shaft 12 is rotatably mounted through the casing 2 and operatively coupled with the motor 9 so that the rotational energy of the motor 9 is transferred into a rotational energy of the spindle shaft 12. The backing plate 32 is terminally mounted to a free end 13 of the spindle shaft 12 thus enabling a polishing pad to be attached. The pump assembly 16 allows the user to selectively discharge a quantity of polishing compound onto the buffing surface and comprises a pump head 17 and a dispensing tube 23. More specifically, the pump head 17 is mounted onto the casing 2. The dispensing tube 23 is in fluid communication with the pump head 17 and concentrically positioned along the spindle shaft 12. The pressurized reservoir 24 is mounted onto the casing 2 so that the collapsible cartridge 29 can be compressionally positioned within the pressurized reservoir 24. The collapsible cartridge 29 that stores the polishing compound is in fluid communication with backing plate 32 through the pump head 17 and the dispensing tube 23. As a result, the user can press the pump assembly 16 upon their preference to discharge the quantity of polishing compound from the collapsible cartridge 29 to the polishing pad through the pump assembly 16.

In reference to FIGS. 1-5, the casing 2, the power source 3, the plurality of control features 4, and the motor 9 function similar to existing polishers. The spindle shaft 12 is a hollow cylindrical body so that the dispensing tube 23 can be inserted through the spindle shaft 12. The polishing device 1 can include circular and non-circular (such as orbital motion) without deviating from the scope of the functionality. The polishing device 1 may further comprise a gear box 14 so that the rotational energy of the motor 9 can be transferred to the spindle shaft 12 within the casing 2. The gear box 14 is internally mounted within the casing 2, and a stator 10 of the motor 9 is internally mounted to the casing 2. As a result, a rotor 11 of the motor 9 is able to rotatably engage with the spindle shaft 12 through the gear box 14. Then, the spindle shaft 12 is able to rotate about a rotational axis thus allowing the backing plate 32 to be also rotated about the rotational axis. The motor 9 within the present invention can be an electric-motor or a pneumatic-motor depending upon the type of polishing device 1. For example, when the polishing device 1 is configured as an electric tool, the electric-motor is utilized as the motor 9. When the polishing device 1 is configured as a pneumatic tool, the pneumatic-motor is utilized as the motor 9.

Figure 4:
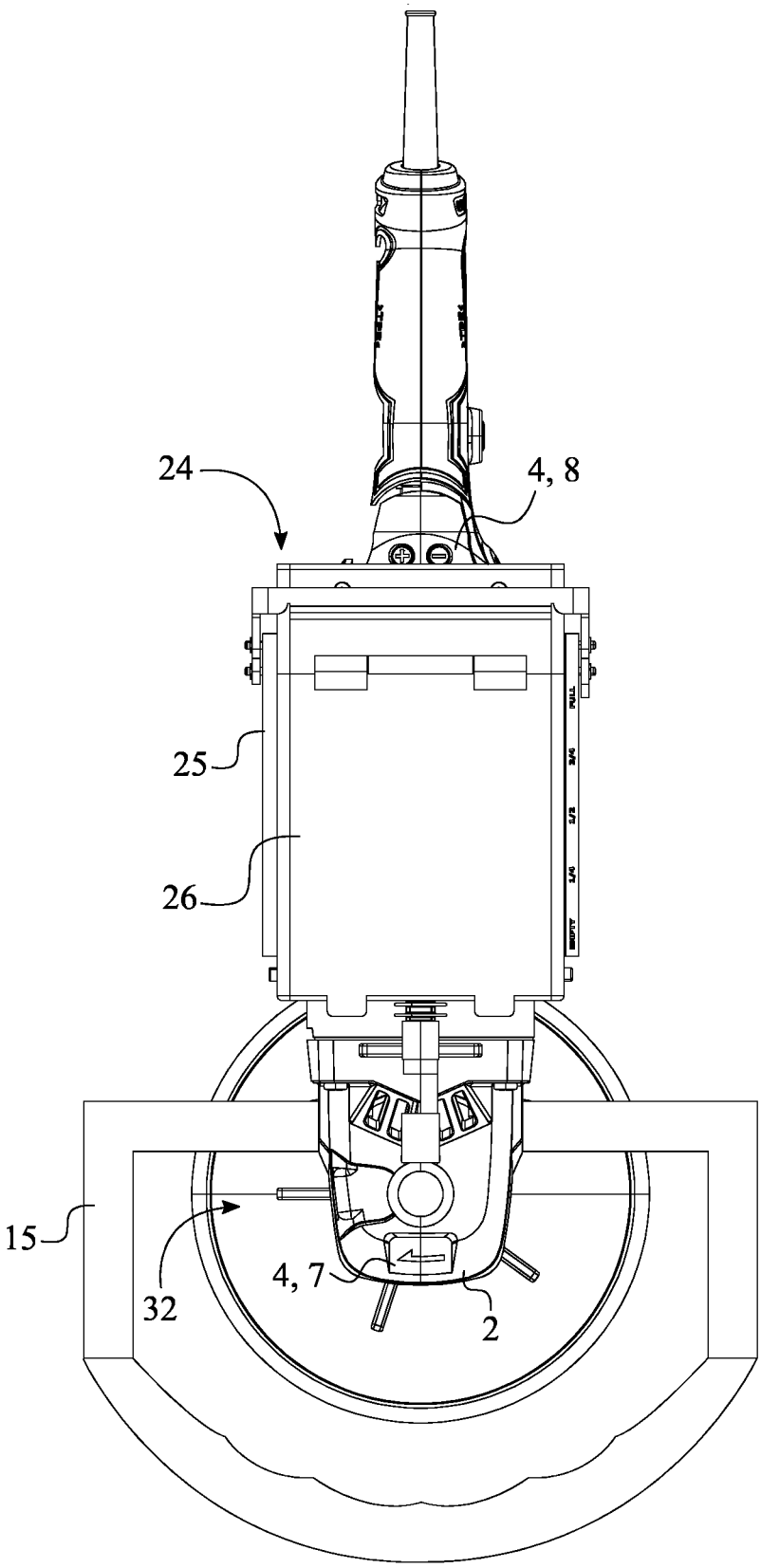
FIG. 4 is a top view of the present invention with the D-shaped handle.
Figure 5:
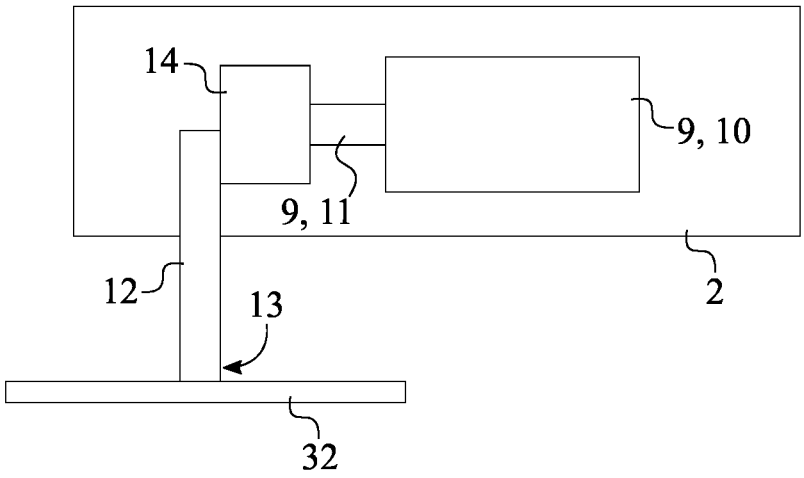
FIG. 5 is a basic schematic view showing the mechanical engagement between the motor, gear box, and the spindle shaft of the present invention.
Figure 6:
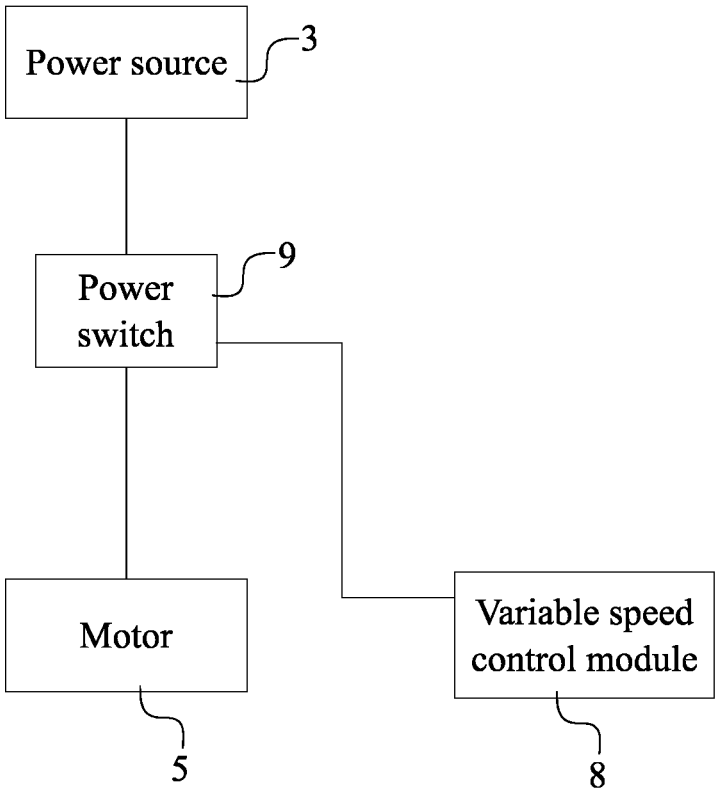
FIG. 6 is a basic schematic view showing the electrical connection of the present invention, wherein the motor is an electric-motor.
Figure 7:
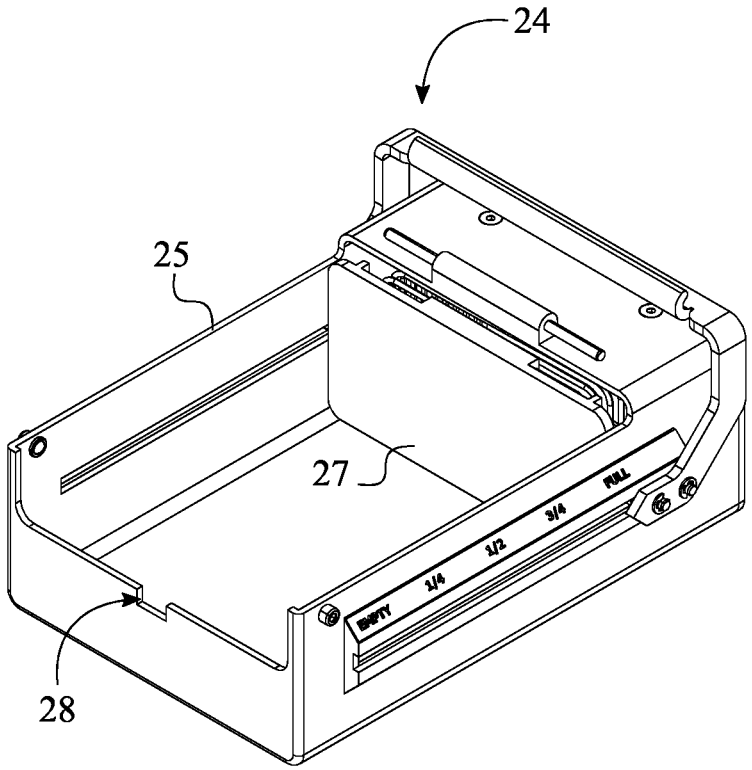
FIG. 7 is a perspective view of the pressurized reservoir of the present invention without showing the lid.

In reference to FIG. 4, the polishing device 1 may further comprise a D-shaped handle 15 so that the user is able to grasp the polishing device 1 with both hands for improved stability. The D-shaped handle 15 is externally mounted to the casing 2 and positioned adjacent to the spindle shaft 12. Furthermore, the D-shaped handle 15 and the backing plate 32 are oppositely positioned of each other about the casing 2. As a result, the user can apply pressure to the polishing pad with one hand via the D-shaped handle 15 and grasp the casing 2 with the other hand. Aforementioned positioning of the D-shaped handle 15 also allows the user to easily access the pump assembly 16 to discharge the quantity of polishing compound without removing the user's hand from the D-shaped handle 15. The casing 2 and the D-shaped handle 15 are formed into ergonomic bodies to reduce fatigue and discomfort of the user's hands.

In reference to FIGS. 1-3 and FIG. 6, the plurality of control features 4 may comprise a power switch 5, a trigger lock 6, a spindle lock 7, and a variable speed control module 8 so that the operation of the polishing device 1 can be optimized. The power source 3 provides necessary electrical power or pneumatic power to the present invention. For example, when the polishing device 1 is configured as an electric tool, the power source 3 is a power extension cord or a rechargeable battery. When the polishing device 1 is configured as a pneumatic tool, the power source 3 is a flow of compressed air. The power switch 5 is positioned adjacent to the power source 3 and connected onto the casing 2 so that the user can easily access the power switch 5 to power the motor 9 electrically or pneumatically. More specifically, the electric-motor is electrically connected to the power source 3 through the power switch 5 so that the user can activate and deactivate the present invention upon pressing and releasing of the power switch 5. The pneumatic-motor is pneumatically connected to the power source 3 through the power switch 5 so that the user can activate and deactivate the present invention upon pressing and releasing of the power switch 5. The trigger lock 6 is connected onto the casing 2 and positioned adjacent to the power switch 5. The trigger lock 6 functions as a safety feature to eliminate accidental pressing of the power switch 5. The spindle lock 7 is connected onto the casing 2 and positioned adjacent to the spindle shaft 12. By pressing the spindle lock 7, the user can maintain a stationary configuration for the spindle shaft 12 to attach the backing plate 32. The variable speed control module 8 allows the user to control the rotational speed of the motor 9. The variable speed control module 8 is connected onto the casing 2 and electrically connected to the power switch 5 when the polishing device 1 is configured as the electric tool.

Figure 9:
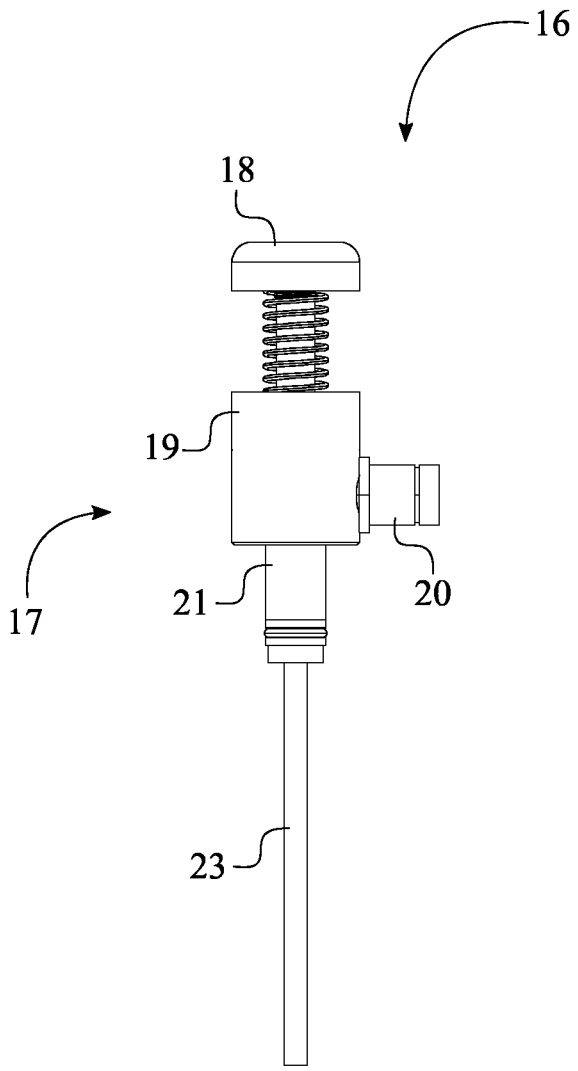
FIG. 9 is a side view of the pump assembly of the present invention.

In reference to FIG. 3 and FIG. 9, the pump head 17 is outwardly extended from the casing 2 and may comprise a pump actuator 18, a pump housing 19, a first check valve 20, and a second check valve 21. The pump housing 19 is connected onto the casing 2 and encloses all of the pump-operational components such as the spring, adaptors, washers, or other related parts. Furthermore, the pump housing 19 functions as a connecting member so that the pump head 17 can be connected to the casing 2. Furthermore, the pump housing 19 functions as a reservoir to store a specific amount of polishing compound in between the first check valve 20 and the second check valve 21. The pump actuator 18 is compressionally connected to the pump housing 19 thus enabling the user to operate the pump assembly 16. The first check valve 20 is integrated into the pump housing 19 and oriented towards the pressurized reservoir 24. The second check valve 21 is integrated into the pump housing 19 and oriented towards the dispensing tube 23. The first check valve 20 is in fluid communication with the second check valve 21 through pump housing 19 so that the pump actuator 18 is able to operate both the first check valve 20 and the second check valve 21 simultaneously. The dispensing tube 23 is connected the second check valve 21 and positioned opposite of the pump actuator 18. The dispensing tube 23 is concentrically extended through the spindle shaft 12 in order to dispense the quantity of polishing compound onto the polishing pad. In other words, the dispensing tube 23 is in fluid communication with the first check valve 20 through the second check valve 21 and the pump housing 19 as the quantity of polishing compound is selectively discharged into the dispensing tube 23 by pressing the pump actuator 18. It is understood that the first check valve 20 prevents backflowing of the quantity of polishing compound into the collapsible cartridge 29 from the pump housing 19 thus providing an accurate meter reading for the discharged amount of the polishing compound. It is also understood that the second check valve 21 prevents drainage of the stored polishing compound from the pump housing 19.

For example, when the pump actuator 18 is not operational, the specific amount of polishing compound is stored within the pump housing 19 as the first check valve 20 prevent backflowing of the polishing compound from the pump housing 19. At the same time, the second check valve 21 prevents drainage of the stored polishing compound into the dispensing tube 23. When the pump actuator 18 is operational, the stored polishing compound that is trapped within the pump housing 19 is discharged into the dispensing tube 23 through the second check valve 21. Due to drainage of the stored polishing compound, the first check valve 20 allows the collapsible cartridge 29 to discharge the quantity of polishing compound into the pump housing 19.

In reference to FIG. 1, FIG. 2, FIG. 7, and FIG. 12, the pressurized reservoir 24 may comprise a housing 25, a lid 26, a spring-loaded pressure plate 27, and a locking channel 28 so that the collapsible cartridge 29 can be secured within to discharge the quantity of polishing compound. The housing 25 is externally mounted onto the casing 2 and preferably formed into a rectangular shape to match the shape of the collapsible cartridge 29. The lid 26 is hingedly connected to the housing 25 so that the housing 25 can be fully closed from the top end. The spring-loaded pressure plate 27 is slidably connected within the housing 25 to apply pressure to a bottom end of the collapsible cartridge 29. The locking channel 28 traverses through the housing 25 and positioned perpendicular to the spring-loaded pressure plate 27. The locking channel 28 allows a spout 31 of the collapsible cartridge 29 traverses through the housing 25 in order to discharge the quantity of polishing compound. The pressurized reservoir 24 may further comprise a measuring gage to indicate the remaining amount of polishing compound within the collapsible cartridge 29. More specifically, the measuring gage is externally integrated onto the housing 25 and visually indicate the positioning of the spring-loaded pressure plate 27. As a result, the user can easily identify the capacity of the collapsible cartridge 29. For example, when the collapsible cartridge 29 is full, the spring-loaded pressure plate 27 is pushed back and aligned with a full measurement indicator of the measuring gage. When the collapsible cartridge 29 is empty, the spring-loaded pressure plate 27 is positioned adjacent to the locking channel 28 and aligned with an empty measurement indicator of the measuring gage.

Figure 8:
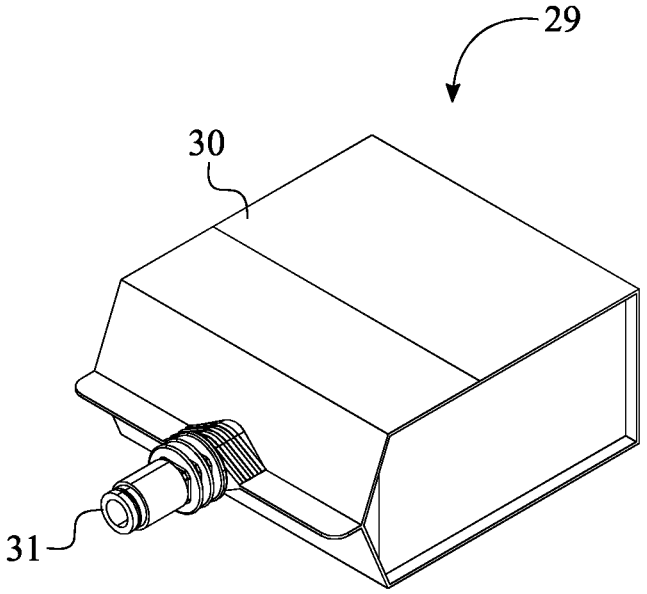
FIG. 8 is a perspective view of the collapsible cartridge of the present invention.

In reference to FIG. 2 and FIG. 8, the collapsible cartridge 29 may comprise a collapsible body 30 and the spout 31. The collapsible body 30 is a flexible container and stores the polishing compound. The collapsible body 30 is in fluid communication with the spout 31 thus allowing the stored polishing compound to be discharged. More specifically, the collapsible body 30 is compressionally positioned within the housing 25 and the spring-loaded pressure plate 27. The spout 31 is engaged within the locking channel 28. Resultantly, when pressure is applied to the collapsible body 30, the quantity of polishing compound is able to discharge through the spout 31. Due to the fact that the first check valve 20 is in fluid communication with the spout 31, the quantity of polishing compound is able to travel to the dispensing tube 23 and the polishing pad when the pump assembly 16 is operational.

Figure 10:
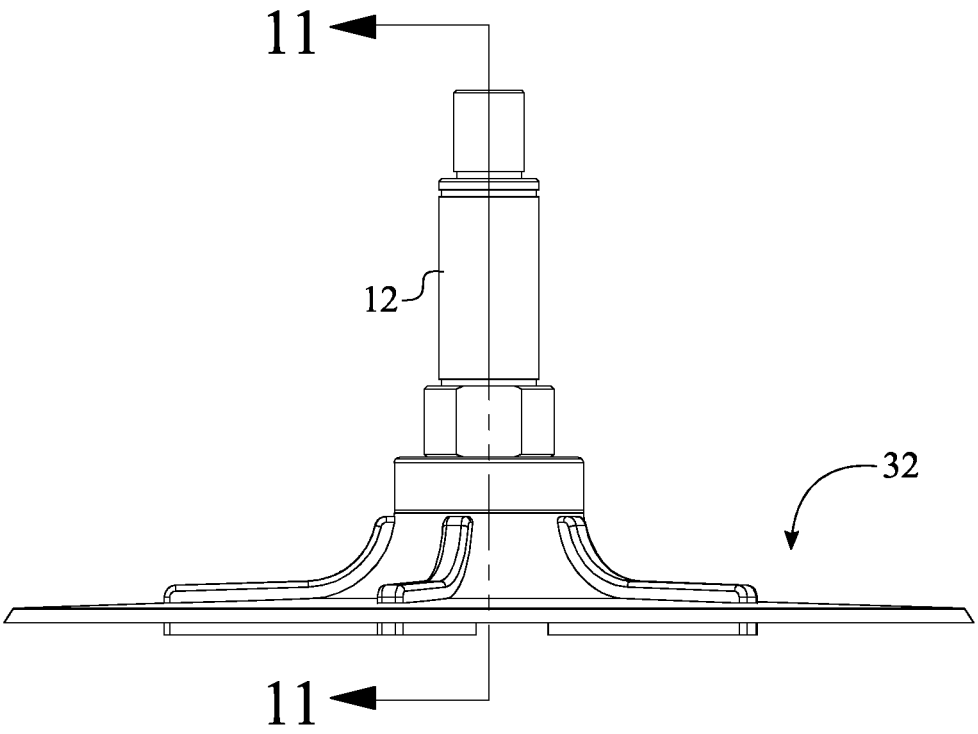
FIG. 10 is a side view of the backing plate, showing the plane upon which a cross sectional view is taken shown in FIG. 11.
Figure 11:
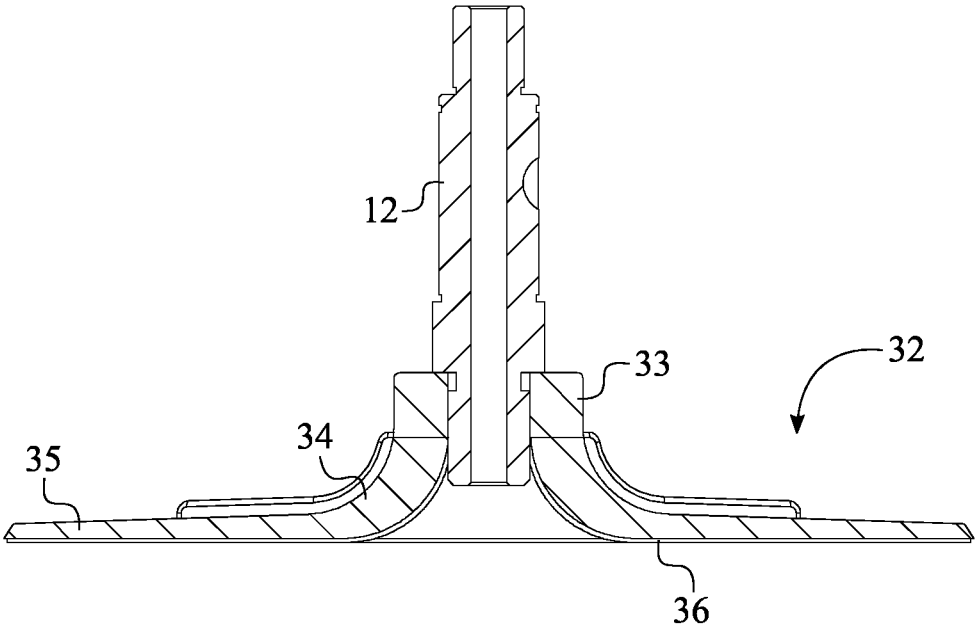
FIG. 11 is a cross section view of the backing plate taken along line 11-11 in FIG. 10.
Figure 12:
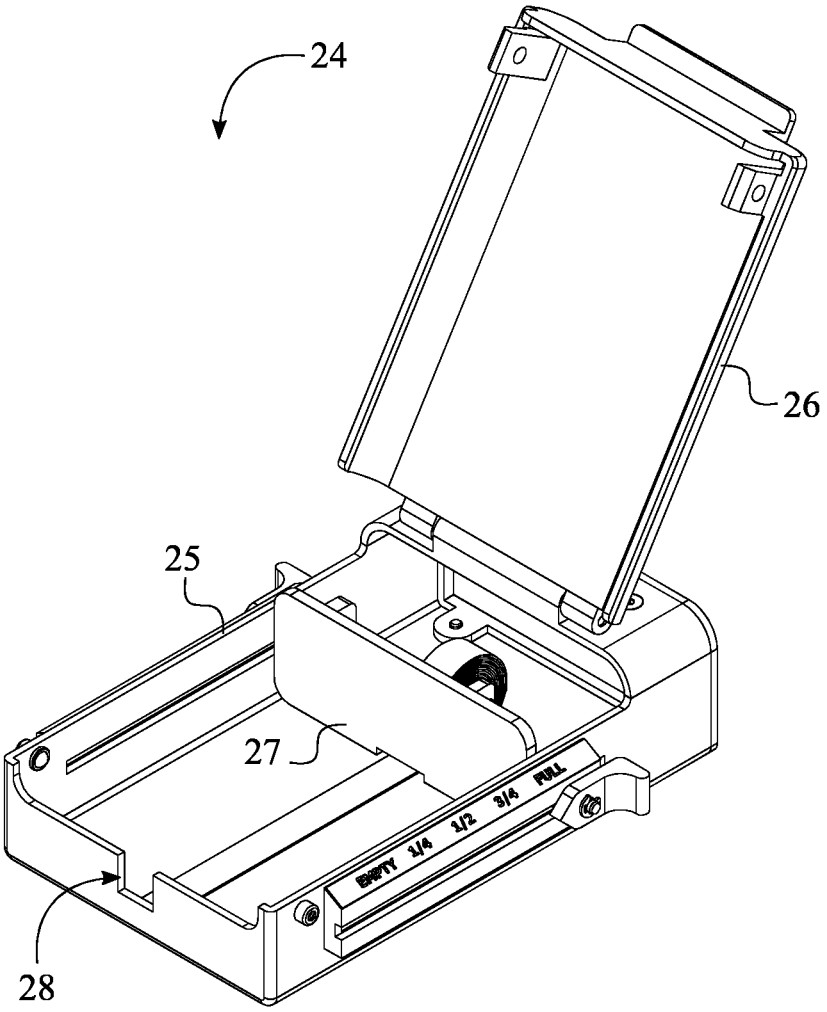
FIG. 12 is a perspective view for an alternative pressurized reservoir of the present invention.

In reference to FIG. 10 and FIG. 11, the backing plate 32 may comprise a mounting nut 33, a concave body 34, a flat body 35, and a layer of interlocking fasteners 36. The mounting nut 33, the concave body 34, and the flat body 35 being concentrically positioned to each other delineating a disk shaped body. More specifically, the concave body 34 is perimetrically connected around the mounting nut 33. The flat body 35 is perimetrically connected around the concave body 34. The mounting nut 33 and the flat body 35 being positioned offset of each other due to the shape of the concave body 34. The mounting nut 33 is attached to the free end 13 of the spindle shaft 12 so that the backing plate 32 can be mounted to the spindle shaft 12. The layer of interlocking fasteners 36 is superimposed onto the concave body 34 and the flat body 35 as the layer of interlocking fasteners 36 and the casing 2 are oppositely positioned of each other about the spindle shaft 12. The layer of interlocking fasteners 36 is preferably a layer of hook fasteners from a hook-and-loop fastener. Then, the layer of interlocking fasteners 36 are able to attach the polishing pad to the concave body 34 and the flat body 35, wherein the polishing pad may or may not be integrated with a layer of loop fasteners from a hook-and-loop fastener.

The polishing pad is also formed similar to the backing plate 32 to provide a secured attachment. More specifically, the polishing pad can comprise a central opening, a convex section, and a flat section. The central opening concentrically traverses through the convex section, wherein the central opening allows the quantity of polishing compound to discharge into the convex section. The flat section is perimetrically connected around the convex section thus completing the general shape of the polishing pad. When a top surface of the polishing pad is attached to the backing plate 32, the convex section is aligned with the concave body 34 and the flat section is aligned with the flat body 35. Furthermore, the polishing pad can further comprise a plurality of radial channels so that the quantity of polishing compound can evenly distributed about the polishing surface. More specifically, the plurality of radial channels traverses into the convex section and the flat section from a bottom surface of the polishing pad so that the quantity of polishing compound can evenly spread throughout the bottom surface of the polishing pad. Furthermore, the polishing pad can further comprise a flange nut so that the quantity of polishing compound can smoothly distributed onto the convex section. More specifically, the flange nut is inserted through the central opening and terminally attached to the mounting nut 33. As a result, the flange nut is able to tighten the convex section to the concave body 34 about the central opening.

When the backing plate 32 is positioned against a polishing surface, the concave body 34 delineate a void between the flat body 35 and the mounting nut 33 thus allowing the dispensing polishing compound to be evenly discharge onto the flat body 35. As a result, the concave body 34 is able to minimize over spraying of the polishing compound and clumping of polishing compound around the mounting nut 33.

In an alternative embodiment of the present invention, the pressurized reservoir 24 would contain said means to move, dispense, and meter surface treating compounds as well as having the delivery conduits for the compounds. The delivery conduits will not be located coaxially with the spindle shaft 12 but rather adjacent to the backing plate 32 when pressurized reservoir 24 is mounted to casing 2. This embodiment and/or attachment creates a self-feeding effect and no modifications for existing Buffing appliances.

Although the invention has been explained in relation to its preferred embodiment, it is to be understood that many other possible modifications and variations can be made without departing from the spirit and scope of the invention as hereinafter claimed.

What is claimed is:

1. A buffer and self-feeding apparatus comprising:

a polishing device;

a pump assembly;

a pressurized reservoir;

a collapsible cartridge;

a backing plate;

the polishing device comprising a casing, a power source, a plurality of control features, a motor, and a spindle shaft;

the pump assembly comprising a pump head and a dispensing tube;

the power source and the plurality of control features being externally integrated onto the casing;

the motor being internally mounted to the casing;

the spindle shaft being rotatably mounted through the casing;

the spindle shaft being operatively coupled with the motor, wherein a rotational energy of the motor is transferred into a rotational energy of the spindle shaft;

the backing plate being terminally mounted to a free end of the spindle shaft;

the pump head being mounted onto the casing;

the dispensing tube being in fluid communication with the pump head;

the dispensing tube being concentrically positioned along the spindle shaft;

the pressurized reservoir being mounted onto the casing;

the collapsible cartridge being compressionally positioned within the pressurized reservoir; and the collapsible cartridge being in fluid communication with the backing plate through the pump head and the dispensing tube.

2. The buffer and self-feeding apparatus as claimed in claim 1 comprising:

the polishing device further comprising a gear box;

the gear box being internally mounted within the casing;

a stator of the motor being internally mounted to the casing; and a rotor of the motor being rotatably engaged with the spindle shaft through the gear box.

3. The buffer and self-feeding apparatus as claimed in claim 1 comprising:

the polishing device further comprising a D-shaped handle;

the D-shaped handle being externally mounted to the casing; and the D-shaped handle and the backing plate being oppositely positioned of each other about the casing.

4. The buffer and self-feeding apparatus as claimed in claim 1 comprising:

the plurality of control features comprising a power switch, a trigger lock, a spindle lock, and a variable speed control module;

the power switch being positioned adjacent to the power source;

the power switch being connected onto the casing;

the trigger lock being connected onto the casing;

the trigger lock being positioned adjacent to the power switch;

the spindle lock being connected onto the casing;

the spindle lock being positioned adjacent to the spindle shaft; and the variable speed control module being connected onto the casing.

5. The buffer and self-feeding apparatus as claimed in claim 1 comprising:

the plurality of control features comprising a power switch and a variable speed control module; and the variable speed control module being electrically connected to the power switch.

6. The buffer and self-feeding apparatus as claimed in claim 1 comprising:

the pump head comprising a pump actuator, a pump housing, and a first check valve, and a second check valve;

the pump housing being connected onto the casing;

the pump actuator being compressionally connected to the pump housing;

the first check valve being integrated into the pump housing;

the second check valve being integrated into the pump housing;

the first check valve being in fluid communication with the second check valve through the pump housing;

the dispensing tube being connected to the second check valve, opposite of the pump actuator;

the dispensing tube being concentrically extended through the spindle shaft; and the dispensing tube being in fluid communication with the first check valve through the second check valve and the pump housing.

7. The buffer and self-feeding apparatus as claimed in claim 1 comprising:

the pressurized reservoir comprising a housing, a lid, a spring-loaded pressure plate, and a locking channel;

the housing being externally mounted onto the casing;

the lid being hingedly connected to the housing;

the spring-loaded pressure plate being slidably connected within the housing;

the locking channel traversing through the housing; and the locking channel being positioned perpendicular to the spring-loaded pressure plate.

8. The buffer and self-feeding apparatus as claimed in claim 1 comprising:

the collapsible cartridge comprising a collapsible body and a spout;

the pressurized reservoir comprising a housing, a spring-loaded pressure plate, and a locking channel;

the pump head comprising a first check valve;

the collapsible body being in fluid communication with the spout;

the collapsible body being compressionally positioned within the housing and the spring-loaded pressure plate;

the spout being engaged within the locking channel; and the first check valve being in fluid communication with the spout.

9. The buffer and self-feeding apparatus as claimed in claim 1 comprising:

the backing plate comprising a mounting nut, a concave body, a flat body, and a layer of interlocking fasteners;

the mounting nut, the concave body, and the flat body being concentrically positioned to each other;

the concave body being perimetrically connected around the mounting nut;

the flat body being perimetrically connected around the concave body;

the mounting nut and the flat body being positioned offset of each other;

the mounting nut being attached to the free end of the spindle shaft;

the layer of interlocking fasteners being superimposed onto the concave body and the flat body; and the layer of interlocking fasteners and the casing being oppositely positioned of each other about the spindle shaft.

* * * * *